US006431048B2

(12) United States Patent
Koiwa et al.

(10) Patent No.: US 6,431,048 B2
(45) Date of Patent: Aug. 13, 2002

(54) COMBINATION ACTUATOR WITH SPEED VARIABLE MECHANISM

(75) Inventors: Kenji Koiwa; Kaichiro Mitsui, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 2 days.

(21) Appl. No.: 09/785,218

(22) Filed: Feb. 20, 2001

(30) Foreign Application Priority Data

Mar. 6, 2000 (JP) ..... 2000-060205

(51) Int. Cl.[7] ..... F15B 15/06

(52) U.S. Cl. ..... 91/394; 92/136; 92/31; 91/402

(58) Field of Search ..... 91/394, 399, 402, 91/409, 61; 92/31, 136

(56) References Cited

U.S. PATENT DOCUMENTS 5,806,402 A * 9/1998 Henry ..... 92/136

5,899,112 A * 5/1999 Richter ..... 92/31

FOREIGN PATENT DOCUMENTS

JP 2000-230509 8/2000

* cited by examiner

*Primary Examiner*—Edward K. Look
*Assistant Examiner*—Thomas E. Lazo
(74) *Attorney, Agent, or Firm*—Oblon, Spivak, McClelland, Maier & Neustadt, P.C.

(57) ABSTRACT

An output shaft is connected to a piston rod of a fluid pressure-driven linear cylinder through a converting mechanism for converting linear thrust of the piston rod into rotational torque and converting operation of the converting mechanism is controlled by operation setting means having a cam groove and a cam follower to thereby causing the output shaft to carry out linear motion and swinging rotation. A driving speed of the piston can be changed by adjusting fluid pressure acting on the piston in a linear motion area and a swinging area of the output shaft respectively.

9 Claims, 4 Drawing Sheets

18
57A
55
56
13
22
61
63
65
69
70
17
70a
64
15
67
14
68a
68
11
16
60
63
63
65
11a
21
64

COMBINATION ACTUATOR WITH SPEED VARIABLE MECHANISM

TECHNICAL FIELD

The present invention relates to a fluid pressure-driven combination actuator which is used for carrying a workpiece, assembly operation, and the like and in which linear reciprocating motion and rotating swinging motion are combined and more specifically to a combination actuator with a speed variable mechanism in which speeds of both linear motion and swinging are variable.

PRIOR ART

Conventionally, a fluid pressure-driven combination actuator for combining and outputting swinging motion and linear motion generally has a basic structure in which a swinging actuator for swinging and rotating an output shaft and a linear cylinder for linearly driving the output shaft are combined. This structure is formed by merely connecting a linear actuator and the swinging actuator which can be driven independently, which hinders miniaturization of the actuator, simplification of a fluid pressure control circuit, reduction of manufacturing cost, and the like. In the above structure, because two or more solenoid valves for driving both the actuators are necessary, much electrical energy and fluid pressure energy are consumed, which hinders energy conservation.

To cope with the above problems, the present inventors proposed, in Japanese Patent Application No. 11-33316, a combination actuator in which two motions, i.e., swinging and linear motion were carried out by one fluid pressure driving system. Although this combination actuator is superior to the above prior-art in that the one fluid pressure driving system (cylinder) is used, a swinging speed of the actuator is restricted by a linear motion speed by the fluid pressure driving system because there is only one fluid pressure driving system and therefore, it is impossible to satisfy demand to individually and arbitrarily adjust the swinging speed and the linear motion speed.

Furthermore, if efforts are made to make it possible to arbitrarily adjust the swinging speed and the linear motion speed by separate actuators, a shock is generated at each motion end to hinder carrying and assembly operations and it is necessary to give consideration to prevention of such a problem.

DISCLOSURE OF THE INVENTION

The present invention has been accomplished to solve the above problems and it is a technical object of the invention to make it possible to individually adjust driving speeds of linear motion and swinging in a combination actuator in which two motions, i.e., the linear motion and swinging can be carried out easily and at low cost by one fluid pressure driving system.

It is another technical object of the invention to provide a combination actuator with a speed variable mechanism in which connection of the linear motion and swinging motion can be achieved with a slight shock.

To achieve the above objects, in a combination actuator of the invention, an output shaft is connected to a piston rod of a fluid pressure-driven liner cylinder through a converting mechanism for converting linear thrust of the piston rod into rotational torque, the output shaft is caused to carry out linear motion and swinging rotation by controlling converting operation of the converting mechanism by operation setting means having a cam groove and a cam follower, and a driving speed of a piston can be changed by adjusting fluid pressure acting on the piston in a linear motion area and a swinging area of the output shaft respectively.

Because the output shaft is coaxially connected to the piston rod of the linear cylinder through a converting mechanism for converting in the combination actuator of the invention with the above structure, the structure can be simplified as compared with the prior-art combination actuator, the number of parts can be reduced, the actuator can be miniaturized, and manufacturing cost can be reduced. Because it is possible to cause the output shaft to carry out necessary combination operation by merely driving the linear cylinder, it is possible to easily control driving of linear motion and swinging by one fluid pressure driving system at low cost. Furthermore, because driving speeds of the linear motion and swinging can be adjusted individually and the driving speed of the piston is changed rapidly but continuously, it is possible to connect the linear motion and swinging motion with a slight shock.

In the invention, the converting mechanism includes a spiral groove provided to one of the piston rod and the output shaft and a connecting member which is provided to the other of the piston rod and the output shaft and which can rotate along the spiral groove.

The speed changing means preferably includes a recessed portion and a throttle for connecting a rod-side pressure chamber of the piston and a port substantially in parallel and means for separating the recessed portion and the rod-side pressure chamber from each other immediately before the piston reaches the swinging area from the linear motion area. The separating means is preferably formed of packing mounted to an inner peripheral face of the recessed portion and a valve ring fitted over an outer periphery of the rod and airtightly fitted into the packing.

According to a concrete embodiment of the invention, a first opening constantly communicating with the rod-side pressure chamber and a second opening in a position corresponding to a boundary between the swinging area and the linear motion area are provided to a bore face of the cylinder bore, the first opening is connected to the port through a check valve for preventing backflow of fluid from the rod-side pressure chamber toward the port, and the second opening is connected to the port through a check valve for preventing backflow of fluid from the cylinder bore toward the port and a throttle for restricting a flow rate of fluid flowing from the port into the cylinder bore.

According to another concrete embodiment of the invention, the packing has a function as a check valve for preventing a flow of fluid from the rod-side pressure chamber toward the port and for allowing a flow of fluid from the port toward the rod-side pressure chamber, an opening is provided in a position corresponding to a boundary portion between the swinging area and the linear motion area in a bore face of the cylinder bore, and the opening and the port are connected to each other through a check valve for preventing backflow of fluid from the cylinder bore toward the port and a throttle for restricting a flow rate of fluid flowing from the port into the cylinder bore.

The throttle is preferably a variable throttle an opening degree of which is adjustable and the driving speed of the piston can be adjusted by adjusting the opening degree.

DETAILED DESCRIPTION

Figure 1:
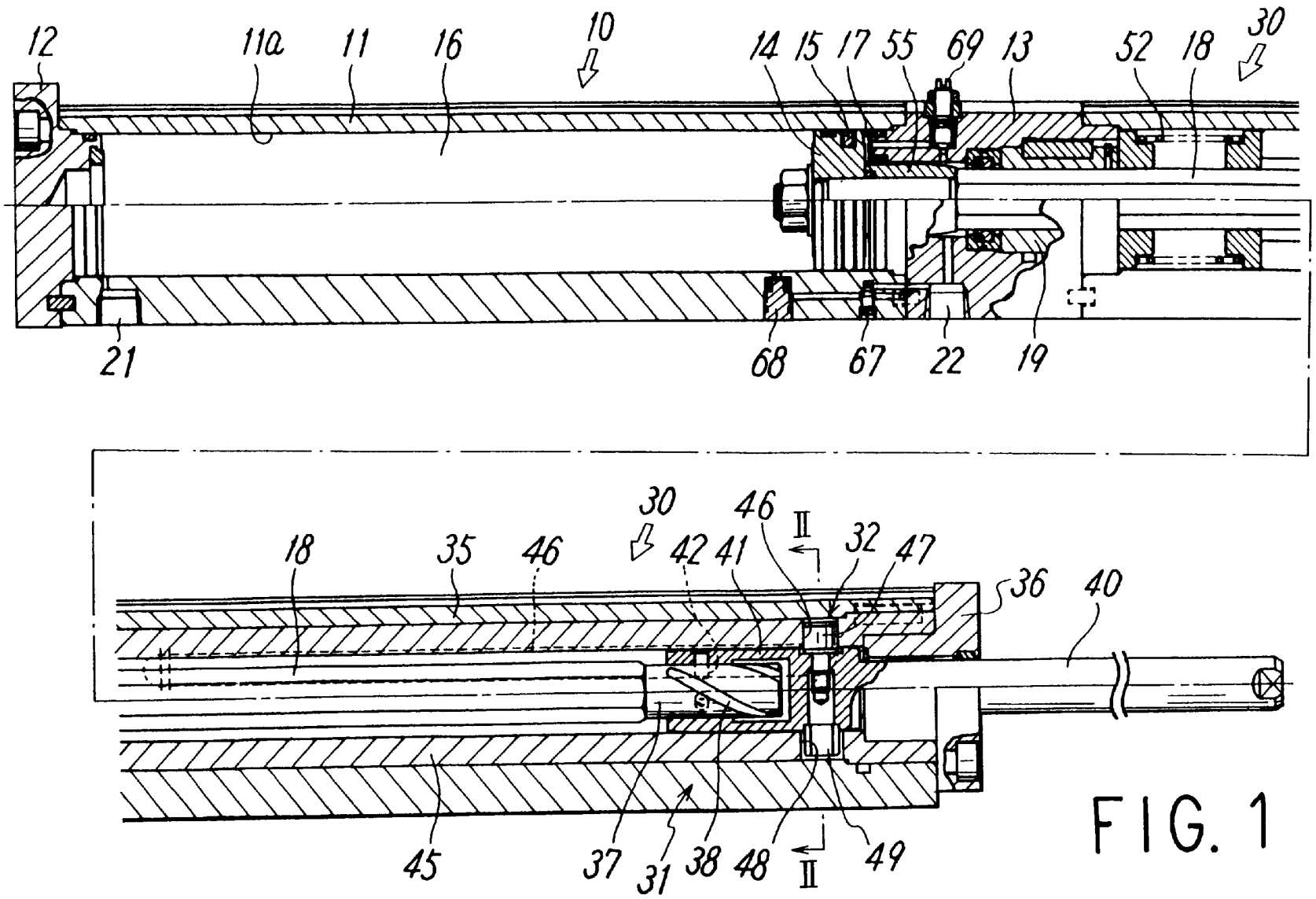
FIG. 1 is a sectional view of an embodiment of a combination actuator according to the present invention.
Figure 2:
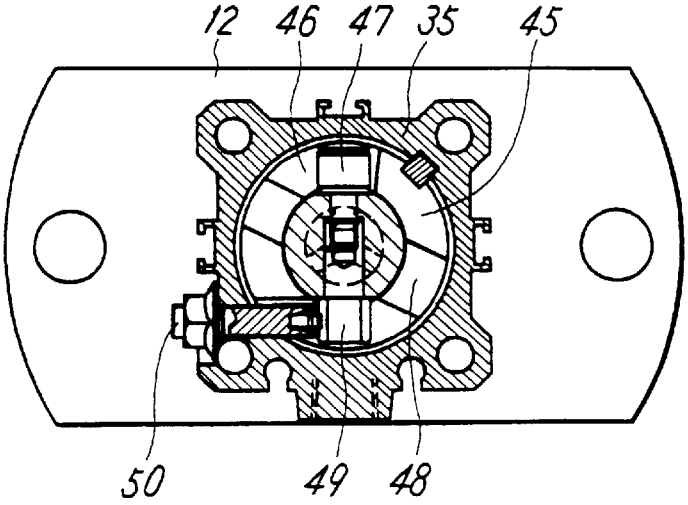
FIG. 2 is a sectional view taken along a line II—II in FIG. 1.
Figure 3:
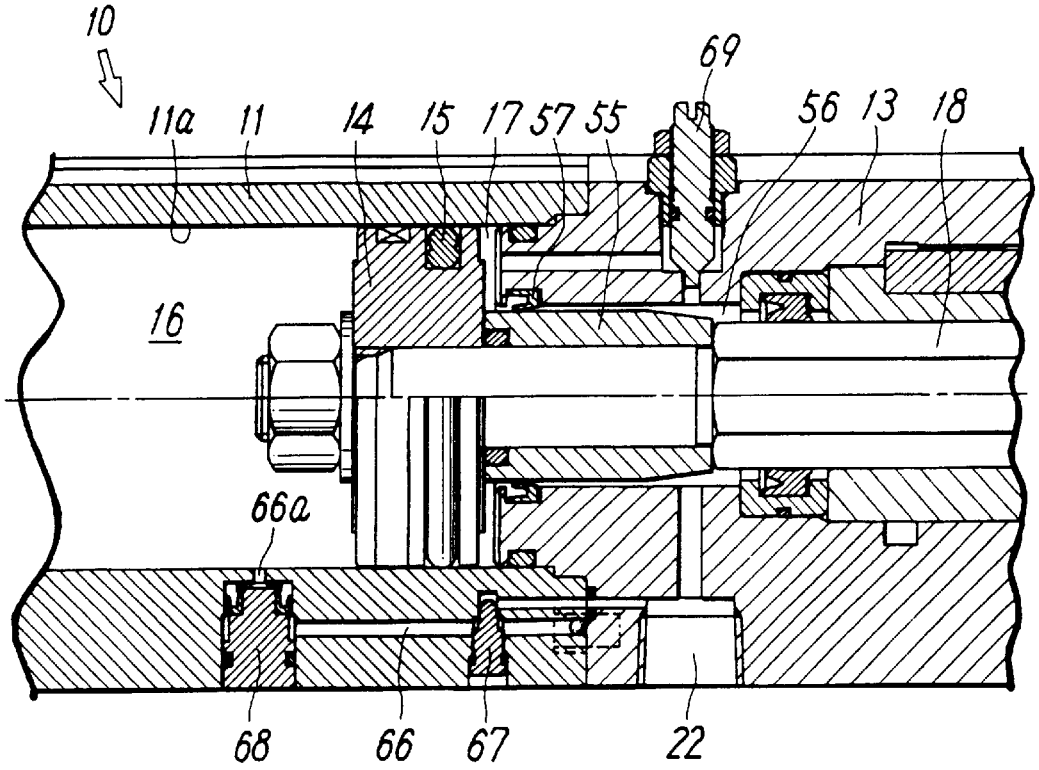
FIG. 3 is an enlarged sectional view of an essential portion of the embodiment.

FIGS. 1 to 3 show an embodiment of a combination actuator with a speed variable mechanism according to the present invention.

The combination actuator is to obtain combination operation which is a combination of two motions, i.e., linear reciprocating motion and rotating swinging motion by one fluid pressure means and generally formed by connecting a linear motion-swinging converting portion 30 including a converting mechanism 31 for converting linear thrust of a linear cylinder 10 driven by fluid pressure into rotational torque and an operation setting mechanism 32 having a cam groove and a cam follower for setting an operation form of swinging rotation to the linear cylinder 10.

The linear cylinder 10 includes a cylinder tube 11 and a head cover 12 and a rod cover 13 mounted to opposite ends of the cylinder tube 11. A piston 14 having piston packing 15 is housed in a cylinder bore 11*a* in the cylinder tube 11 and pressure chambers 16 and 17 are defined on opposite sides of the piston 14. A piston rod 18 connected to the piston 14 has a modified sectional shape such as a hexagon, rotation of the piston rod 18 is restricted by inserting the piston rod 18 into a bearing hole having a modified section of a rotation-preventing busing 19 provided to the rod cover 13, and the piston rod 18 extends from the rod cover 13 into the linear motion-swinging converting portion 30. It is possible to apply other proper rotation-preventing mechanisms to the piston rod 18 or the piston 14. The pressure chambers 16 and 17 respectively communicate with ports 21 and 22 opening to an outside of the cylinder tube 11 and for supplying and discharging compressed air. A fluid pressure supply/discharge system including a speed variable mechanism for changing a speed of the piston 14 respectively in a linear motion area and a swinging rotation area will be described later by using FIGS. 3 to 5.

A spiral groove member 37 forming the converting mechanism 31 for converting the linear thrust into the rotational torque is integrally connected to a tip end of the piston rod 18 introduced into an outer tube 35 of the linear motion-swinging converting portion 30 and a plurality of spiral grooves 38 are formed on an outer face of the spiral groove member 37. An output shaft 40 is disposed in the outer tube 35 so as to be positioned on the same axis as the piston rod 18 and a tip end of the output shaft 40 projects from an end cover 36 to an outside for rotation and swinging. A cylindrical connecting member 41 fitted over an outer periphery of the spiral groove member 37 is provided to a base end portion of the output shaft 40 and a pin 42 to be fitted into the spiral grooves 38 of the spiral groove member 37 is provided on an inner peripheral face of the connecting member 41. The converting mechanism 31 is formed of the spiral groove member 37 having these spiral grooves 38 and the connecting member 41 having the pin 42 and a multiple thread with a large lead angle is used as the spiral groove 38. Therefore, if linear thrust acts on the piston rod 18, rotational torque generates in the connecting member 41 due to combined operation of the spiral groove 38 and the pin 42.

The converting mechanism 31 is not limited to the above-described structure but may be other structures which can convert the linear thrust of the piston rod 18 into swinging rotation force and in which the connecting member 41 is formed into a nut shape to be connected by screwing to the spiral groove 38 or the spiral groove is provided to the connecting member 41 and the pin to be fitted in the spiral groove is provided to the spiral groove member 37 side, for example.

The operation setting mechanism 32 provided to the linear motion-swinging converting portion 30 has a cam groove 46 formed in a cam sleeve 45 fitted in the outer tube 35 and a cam follower 47 in a shape of a small roller provided to a base portion of the output shaft 40 and fitted into the cam groove 46.

The cam groove 46 is for controlling converting operation of the converting mechanism 31 to apply linear motion and swinging rotating motion to the output shaft 40. Although the cam groove 46 is in a shape linearly extending from an end portion of the cam sleeve 45 on the rod cover 13 side along an axis of the cam sleeve 45 and then bent substantially in an L shape along a circumference of the cam sleeve 45 at an end portion of the cam sleeve 45 on the end cover 36 side as shown with a dotted line in FIG. 1 in the embodiment shown in the drawings, the cam groove 46 is not limited to this shape.

As described above, the converting mechanism 31 for converting the linear thrust into the rotational torque is provided between the piston rod 18 and the output shaft 40 and the rotary torque generates in the output shaft 40 when the linear thrust acts on the piston rod 18. Because the cam follower 47 provided to the output shaft 40 is fitted into the cam groove 46 provided to the cam sleeve 45, rotating operation of the output shaft 40 is restricted by the cam groove 46 and the output shaft 40 swings and rotates only at a portion where the cam groove 46 curves in the circumferential direction of the cam sleeve 45. It is also possible to provide the cam follower 47 to the cam sleeve 45 side and to provide the cam groove 46 to the output shaft 40 side in some instances.

An adjust groove 48 similar to the cam groove 46 is provided to the cam sleeve 45, a stopper pin 49 to be fitted in the groove 48 is mounted to the output shaft 40, and an adjust bolt 50 projecting into the adjust groove 48 so as to set a stop position of the output shaft 40 is screwed down into the outer tube 35.

In FIG. 1, a reference numeral 52 designates a spring for obtaining backlash.

Next, by reference to FIGS. 3 and 4, the fluid pressure supply/discharge system including a speed variable mechanism for changing a driving speed of the piston respectively in the linear motion area and the swinging rotation area of the output shaft 40 will be described.

In order to change the speed of the piston 14 in a boundary portion between the linear motion area and the swinging rotation area, a valve ring 55 having a tip end portion with a diameter reduced in a tapered manner is fitted with a portion of the base end portion of the piston rod 18 to be connected to the piston 14, a recessed portion 56 into which the valve ring 55 is fitted is formed in the rod cover 13, and packing 57 in a shape of a lip seal in contact with a periphery of the valve ring 55 is mounted to an end portion of an inner peripheral face of the recessed portion 56 close to the rod-side pressure chamber 17, as shown in FIG. 3. The packing 57 functions as a check valve for allowing a flow of air from the recessed portion 56 side into the rod-side pressure chamber 17 and for preventing a flow in a reverse direction. There is such a relationship between the valve ring 55 and the packing 57 that the tip end of the valve ring 55 comes in contact with the packing 57 at a stage at which the cam follower 47 provided to the output shaft 40 moves from the linear motion area to the swinging rotation area in the cam groove 46.

The one supply/discharge port 21 directly communicates with the head-side pressure chamber 16 in the cylinder tube 11 and the other supply/discharge port 22 opens into the recessed portion 56 to thereby communicate with the rod-side pressure chamber 17 through the recessed portion 56 and simultaneously communicate with the rod-side pressure chamber 17 though a variable throttle 69 provided to the rod cover 13 so as to connect the recessed portion 56 and the rod-side pressure chamber 17. Therefore, the recessed portion 56 and the variable throttle 69 are connected substantially in parallel between the rod-side pressure chamber 17 and the port 22.

Although the case of the structure in which the valve ring 55 is fitted into the packing 57 disposed in a mouth portion of the recessed portion 56 to avoid direct connection between the pressure chamber 17 and the supply/discharge port 22 is shown here, it is also possible that the piston packing 15 of the piston 14 gets over an opening communicating with the supply/discharge port 22 to thereby close the opening without providing the recessed portion 56.

Figure 4:
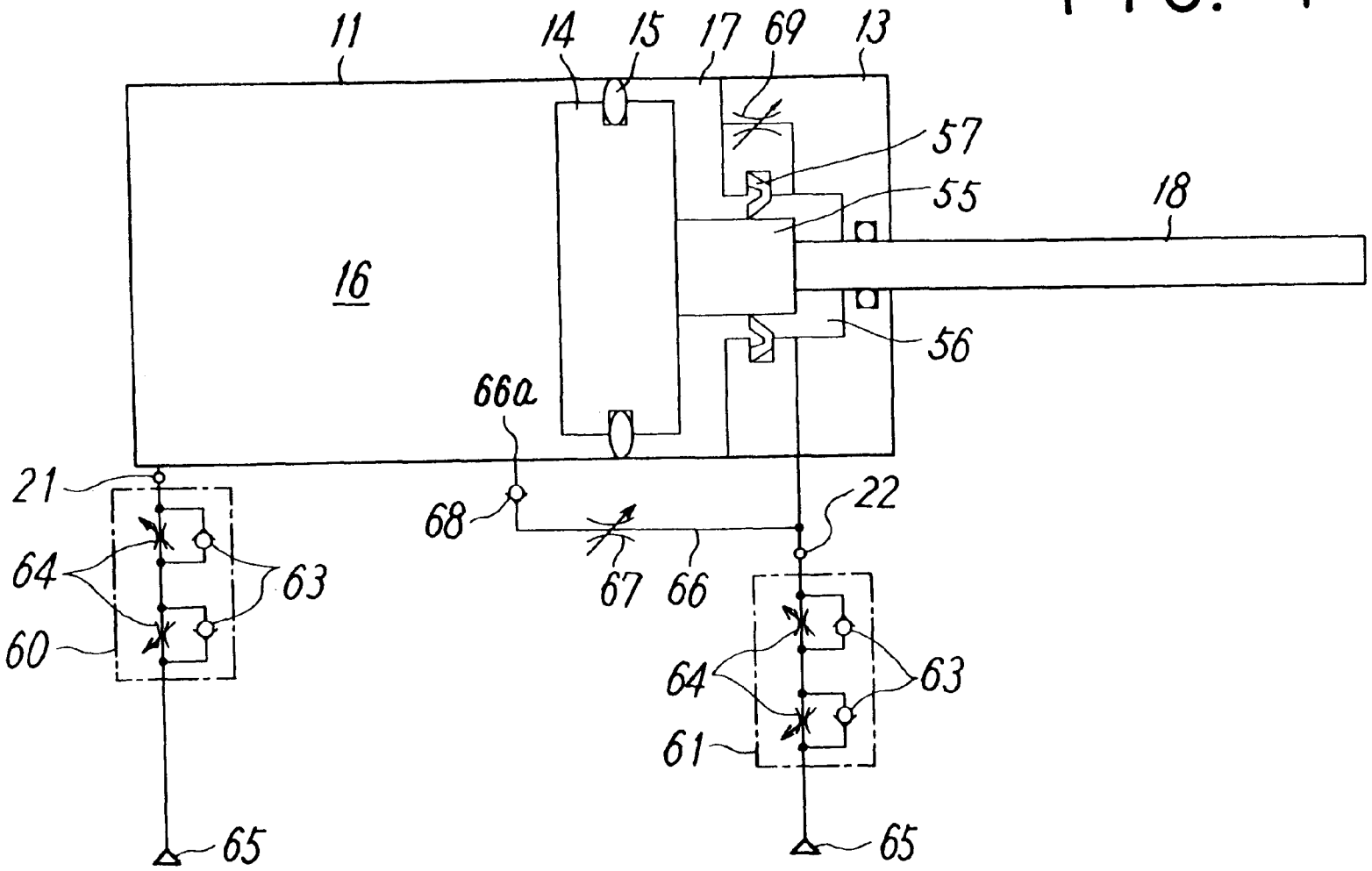
FIG. 4 is a block diagram of a fluid pressure supply/discharge system of the combination actuator.

FIG. 4 is a schematic diagram of the fluid pressure supply/discharge system of the linear cylinder 10. The head-side and rod-side supply/discharge ports 21 and 22 of the linear cylinder 10 are connected to a common compressed air source 65 through speed controllers 60 and 61 respectively. Each of the speed controllers 60 and 61 is formed by disposing two discrete controllers in series in a flow path, each the discrete controller including a check valve 63 and a variable throttle 64 connected in parallel and the check valves being in opposite orientations in the two discrete controllers. A branch path 66 which branches from the supply/discharge port 22 is connected to the pressure chamber 16 through a variable throttle 67 and a check valve 68 for allowing only a flow of air from the port 22 into the pressure chamber 16. An opening 66*a* of the branch path 66 is provided in such a position that the piston packing 15 passes over the opening 66*a* when the valve ring 55 moves away from the packing 57 in the recessed portion 56. In other words, this position corresponds to a boundary portion between the swinging area and the linear motion area of the output shaft 40.

In the combination actuator with the above structure, if the piston 14 and the piston rod 18 of the linear cylinder 10 are positioned at a rearward stroke end at a left end of the cylinder tube 11 and the output shaft 40 is also positioned at the rearward stroke end, which is opposite to an operation position in FIG. 1, the cam follower 47 is positioned at an end portion of a linear portion of the cam groove 46. If the one supply/discharge port 22 is open into the atmosphere and compressed air is supplied to the head-side pressure chamber 16 through the other supply/discharge port 21 in this state, the piston 14 moves forward and rightward and the piston rod 18 rotation of which is restricted is driven linearly. The output shaft 40 is pushed by the piston rod 18 through the spiral groove member 37 and the connecting member 41 of the converting mechanism 31 to move forward and together. As a result, the cam follower 47 also moves in the cam groove 46. At this time, the output shaft 40 tries to rotate due to operation of the spiral grooves 38 and the pin 42. However, the rotation is restricted by operation of the cam groove 46 and the cam follower 47 in the operation setting mechanism 32 and the output shaft 40 carries out operation according to a groove shape of the cam groove 46. In other words, the output shaft 40 is prevented from rotating and carries out the linear motion while the cam follower 47 moves in the linear portion of the cam groove 46. When the cam follower 47 reaches the bent portion at the tip end of the cam groove 46, the linear motion of the piston rod 18 is converted into the rotating motion by the spiral grooves 38 and the pin 42 in this position, and the output shaft 40 rotates about the axis and reaches a forward stroke end in FIG. 1.

If the supply/discharge port 21 is open into the atmosphere and compressed air is supplied to the supply/discharge port 22 to drive the piston 14 from the state in FIG. 1, the output shaft 40 moves to the rearward stroke end while carrying out the rotating motion and the linear motion in totally reverse order to the above case.

In the combination actuator which operates as described above, while the piston 14 starts moving forward from the rearward stroke end at the left end in FIG. 1 and the valve ring 55 is fitted into the packing 57 in the recessed portion 56, i.e., in the linear motion area of the output shaft 40, the driving speed of the piston 14 is set by opening degrees of the variable throttles 64 of the speed controllers 60 and 61. When the piston 14 approaches the forward stroke end and comes to the boundary between the linear motion area and the swinging rotation area of the output shaft 40, the valve ring 55 is fitted into the recessed portion 56. As a result, a discharge path of compressed air from the rod-side pressure chamber 17 is changed to a flow path extending from the variable throttle 69 through the recessed portion 56 to the supply/discharge port 22 while a discharge flow path extending from the recessed portion 56 directly to the supply/discharge port 22 is closed. Therefore, reduction in pressure in the pressure chamber 17 is restricted by the throttle 69 and the speed of the piston 14 is reduced to a speed according to an opening degree of the throttle 69. As a result, a speed of swinging rotation of the output shaft 40 is reduced to a speed determined by the opening degree of the throttle 69.

If the piston 14 moves rearward and leftward from the operation position in FIG. 1, compressed air supplied from the supply/discharge port 22 flows from the recessed portion 56 through the directional packing 57 into the rod-side pressure chamber 17 and drives the piston 14. At this time, until the piston packing 15 gets over the opening 66*a* of the branch path 66, compressed air from the supply/discharge port 22 flows into the pressure chamber 16 on the opposite side though the branch path 66 while being restricted by the variable throttle 67. Therefore, the compressed air functions as back pressure to restrict the driving speed of the piston 14. When the piston packing 15 gets over the opening 66*a*, the piston 14 moves at the speed set by the speed controllers 60 and 61.

Because the driving speed of the piston 14 is changed in the areas of linear motion and swinging rotation from each other in the combination actuator as described above, the driving speeds of linear motion and swinging can be adjusted individually by adjustment of the respective variable throttles. Moreover, because change of the driving speed of the piston 14 is carried out rapidly but continuously, it is possible to connect the linear motion and the swinging motion with a slight shock.

Figure 5:
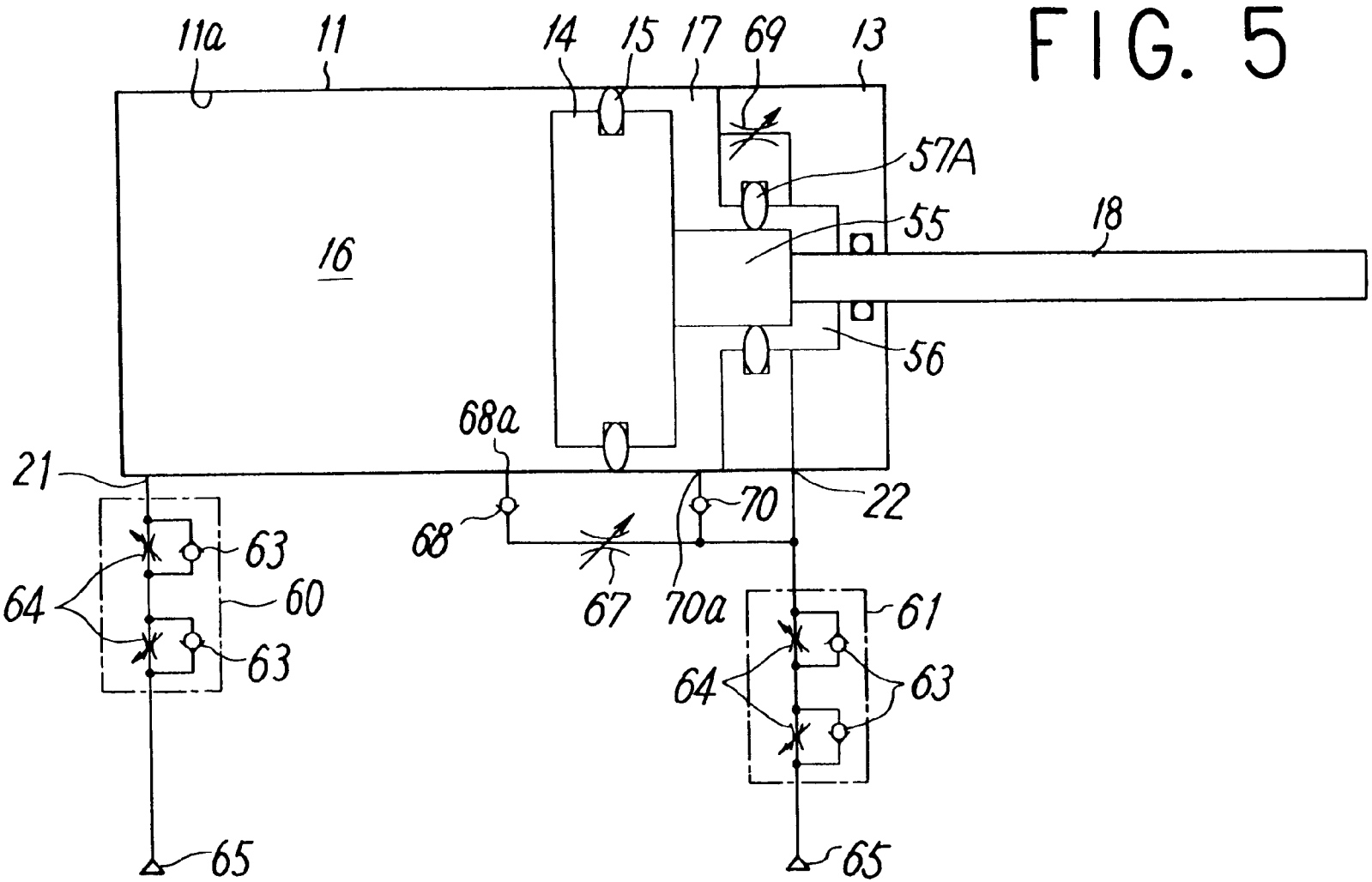
FIG. 5 is a block diagram of another fluid pressure supply/discharge system of the combination actuator.

In an embodiment shown in FIG. 5, nondirectional packing 57A is used instead of the directional packing 57 in FIG. 4 and compressed air is supplied to the rod-side pressure chamber 17 through a check valve 70 for allowing only a flow of air from the branch path 66 toward the pressure chamber 17. In other words, a first opening 70*a* that constantly communicates with the rod-side pressure chamber 17 and a second opening 68*a* that is in a position corresponding to the boundary between the swinging area and the linear motion area are provided to a bore face of the cylinder bore 11*a,* the first opening 70*a* is connected to the port 22 through the check valve 70, and the second opening 68*a* is connected to the port 22 through the check valve 68 for preventing backflow of fluid from the cylinder hole 11*a* toward the port 22 and the variable throttle 67 for restricting a flow rate of fluid flowing from the port 22 to the cylinder bore 11*a*.

Because other structures and operations of the embodiment is not especially different from those in FIG. 4, such structures in FIG. 5 are provided with reference numerals similar to those in FIG. 4 to omit description of them.

According to the invention described above in detail, it is possible to provide the combination actuator with the speed variable mechanism in which the output shaft can be caused to carry out the combination operation of linear motion and swinging by one fluid pressure driving system, speeds of the linear motion and swinging can be adjusted individually, and connection between the linear motion and swinging motion can be achieved with the slight shock.

What is claimed is:

1. A fluid pressure-driven combination actuator having an output shaft for carrying out an operation which is a combination of linear reciprocating motion and rotating swinging motion, said actuator comprising, a linear cylinder including a piston for carrying out linear reciprocating motion in a cylinder bore by operation of fluid pressure and a piston rod connected to said piston, means for restricting rotation of said piston rod, said output shaft which is disposed coaxially with said piston rod and which can move forward and rearward and can rotate, a converting mechanism provided between said piston rod and said output shaft and having a function of connecting said piston rod and said output shaft and a function of converting linear thrust of said piston rod into rotational torque to transmit said rotational torque to said output shaft, operation setting means which includes a cam groove formed in one of said output shaft and a fixed side member surrounding said output shaft and a cam follower formed in the other of said output shaft and said fixed side member and fitted into said cam groove and which applies linear motion and swinging motion to said output shaft by controlling said converting operation of said converting mechanism, and speed changing means which includes a plurality of fluid flow paths with different flow rates and which adjusts fluid pressure acting on said piston according to an operation position of said piston by switching between said flow paths according to operation of said piston to thereby make it possible to change a driving speed of said piston in a linear motion area and a swinging area of said output shaft from each other.

2. A combination actuator according to claim 1, wherein said converting mechanism includes a spiral groove provided to one of said piston rod and said output shaft and a connecting member which is provided to the other of said piston rod and said output shaft and which can rotate along said spiral groove.

3. A combination actuator according to claim 1, wherein said speed changing means includes a recessed portion and a throttle for connecting a rod-side pressure chamber of said piston and a port substantially in parallel and means for separating said recessed portion and said rod-side pressure chamber from each other immediately before said piston reaches said swinging area from said linear motion area.

4. A combination actuator according to claim 3, wherein said means for separating said recessed portion and said rod-side pressure chamber from each other is formed of packing mounted to an inner peripheral face of said recessed portion and a valve ring fitted over an outer periphery of said rod and airtightly fitted into said packing.

5. A combination actuator according to claim 4, wherein a first opening constantly communicating with said rod-side pressure chamber and a second opening in a position corresponding to a boundary between said swinging area and said linear motion area are provided to a bore face of said cylinder bore, said first opening is connected to said port through a check valve for preventing backflow of fluid from said rod-side pressure chamber toward said port, and said second opening is connected to said port through a check valve for preventing backflow of fluid from said cylinder bore toward said port and a throttle for restricting a flow rate of fluid flowing from said port into said cylinder bore.

6. A combination actuator according to claim 4, wherein said packing has a function as a check valve for preventing a flow of fluid from said rod-side pressure chamber toward said port and for allowing a flow of fluid from said port toward said rod-side pressure chamber, an opening is provided in a position corresponding to a boundary portion between said swinging area and said linear motion area in a bore face of said cylinder bore, and said opening and said port are connected to each other through a check valve for preventing backflow of fluid from said cylinder bore toward said port and a throttle for restricting a flow rate of fluid flowing from said port into said cylinder bore.

7. A combination actuator according to claim 3, wherein said throttle is a variable throttle an opening degree of which is adjustable and said driving speed of said piston can be adjusted by adjusting said opening degree.

8. A combination actuator with a speed variable mechanism comprising, a linear cylinder including a piston for carrying out linear reciprocating motion in a cylinder bore by operation of fluid pressure, a piston rod for moving with said piston while rotation of said piston rod being restricted, a head-side pressure chamber and a rod-side pressure chamber defined on opposite sides of said piston, and a port communicating with said pressure chambers, a linear motion-swinging converting portion connected to a rod side of said linear cylinder, an output shaft disposed in said converting portion to be coaxial with said piston rod such that said output shaft can move forward and rearward and rotate and that a tip end of said output shaft extends from said converting portion to an outside, a converting mechanism provided between said piston rod and said output shaft in said converting portion and having a function of connecting said piston rod and said output shaft and a function of converting linear thrust of said piston rod into rotational torque to transmit said rotational torque to a rotary shaft, operation setting means which is formed of a cam groove formed in a cam sleeve fitted into said converting portion and a cam follower provided to said output shaft and fitted into said cam groove and which applies linear motion and swinging motion to said output shaft by controlling said converting operation of said converting mechanism, and speed changing means including a recessed portion and a throttle connected between said rod-side pressure chamber and said port substantially in parallel, packing mounted to an inner peripheral face of said recessed portion, and a valve ring which is fitted over an outer periphery of said rod and which is airtightly fitted into said packing immediately before said piston reaches a swinging area from a linear motion area to thereby separate said recessed portion from said rod-side pressure chamber.

9. A combination actuator according to claim 8, wherein said converting mechanism includes a spiral groove provided to one of said piston rod and said output shaft and a connecting member which is provided to the other of said piston rod and said output shaft and which can rotate along said spiral groove.

* * * * *